US006075424A

United States Patent [19]

Hampel et al.

[11] Patent Number: 6,075,424

[45] Date of Patent: Jun. 13, 2000

[54] ARTICLE COMPRISING A PHASE SHIFTER HAVING A MOVABLE DIELECTRIC ELEMENT

[75] Inventors: Karl Georg Hampel, New York, N.Y.; Gary M. Hojell, Kinnelon, N.J.

[73] Assignee: Lucent Technologies, Inc., Murray Hill, N.J.

[21] Appl. No.: 09/040,850

[22] Filed: Mar. 18, 1998

[51] Int. Cl.[7] ..... H01P 1/18

[52] U.S. Cl. ..... 333/161; 333/34

[58] Field of Search ..... 333/161, 156, 333/34

[56] References Cited

U.S. PATENT DOCUMENTS

| | | | |
|---|---|---|---|
| 3,440,573 | 4/1969 | Butler | 333/161 |
| 3,656,179 | 4/1972 | DeLoach | 333/161 |
| 5,949,303 | 9/1999 | Arvidsson et al. | 333/161 |

FOREIGN PATENT DOCUMENTS

| | | | |
|---|---|---|---|
| 117801 | 7/1984 | Japan | 333/161 |

*Primary Examiner*—Benny Lee

[57] ABSTRACT

A phase shifter including a phase-shifting slab having a phase-shifting member is used in conjunction with a quasi-TEM transmission line having at least one active line and one ground. In some embodiments, the phase-shifting slab is inserted between the active line and the ground. The phase-shifting member is advantageously configured so that as it is advanced between the active line and the ground plane, a varying amount of dielectric material passes therebetween. Varying the amount of dielectric material between the active line and the ground changes the effective dielectric constant of the transmission line. Such a change in the effective dielectric constant causes a change in the propagation velocity of a signal traveling through the transmission line. In that manner, a phase shift is introduced in the signal relative to other signals. The phase-shifting slab advantageously comprises at least one impedance-matching member that decreases or eliminates an impedance mismatch that occurs between air-suspended and dielectrically-loaded regions of the transmission line. In some embodiments, the impedance mismatch is decreased or eliminated over the entire phase-shifting range. Decreasing the impedance mismatch may advantageously reduce the incidence and severity of signal reflections.

12 Claims, 7 Drawing Sheets

ARTICLE COMPRISING A PHASE SHIFTER HAVING A MOVABLE DIELECTRIC ELEMENT

STATEMENT OF RELATED CASES

The present case is related to applicants' U.S. Pat. No. 5,905,462 and U.S. Pat. No. 5,940,030 both of which were filed on even date herewith and assigned to the present assignee.

FIELD OF THE INVENTION

The present invention relates to telecommunications. More particularly, the present invention relates to a phase shifter for use in conjunction with a phased-array antenna for the purpose of beam steering/tilting.

BACKGROUND OF THE INVENTION

A phased-array antenna is a directive antenna having several individual, suitably-spaced radiating antennas, or elements. The phased array generates a radiation pattern ("beam") having a main lobe and side lobes that is determined by the collective action of all the radiating elements in the array. The response of each radiating element is a function of the specific phase and amplitude of a signal applied to the element. By varying the relative phases of the signals applied to the individual radiating elements, the beam can be advantageously changed in azimuth ("beam steering"), elevation ("beam tilting") or both.

Beam steering/tilting has a number of applications. Of major significance is its application to the field of wireless telecommunications. The geographic area serviced by a wireless telecommunications system is partitioned into a number of spatially-distinct areas called "cells." Each cell usually has an irregular shape (though idealized as a hexagon) that depends on terrain topography. Typically, each cell contains a base station, which includes, among other equipment, radios and antennas that the base station uses to communicate with the wireless terminals in that cell. Due to instantaneous geographic variations in communications traffic, it may be desirable, at times, to adjust the geographic coverage of a particular base station. This can be accomplished by beam steering/tilting.

There are a variety of different ways to obtain a relative phase change between the signals applied to the various antenna elements for beam steering/tilting. The change in phase $\phi$ experienced by an electromagnetic wave of frequency f propagating with a velocity v through a transmission line of length l is given by the expression: $\phi=2\pi fl/v$. As is well known to those skilled in the art, the velocity v of an electromagnetic wave is a function of the permeability $\mu$ and the dielectric constant $\epsilon$ of the medium in which the wave propagates. Thus, phase can be changed by altering frequency, line length, propagation velocity, permeability or dielectric constant.

Devices for causing a differential phase change ("phase shifters") utilizing the aforementioned phase-shifting techniques are known. One type of phase shifter utilizes switchable delay lines having different lengths. Such a phase shifter is usually big and expensive. Moreover, due to the discrete nature of such a device, an error in desired phase will typically be present. A second type of device is a solid-state hybrid-coupled-diode phase shifter. Such devices suffer from high insertion loss and nonlinearity. As a result of such high insertion loss, amplifiers are required at the top of a base station tower to increase signal levels. At the high power levels required for transmission, such amplifiers are heavy, big and expensive. Such amplifiers are considerably smaller and less expensive at "receive" power levels, although it is still generally undesirable to have such active RF electronics at the top of a tower.

A third type of phase shifter uses a ferrimagnetic material (a ferrite). It is known that the permeability of a ferrite can be changed by varying an applied D.C. magnetic field. Such a permeability change results in a change in the propagation speed of an electromagnetic wave traveling through the ferrite, resulting in phase shift. Traditionally, ferrite phase shifters have been quite large, heavy and expensive. More recently, thin-film ferrites has been utilized for such shifters, which reduces their size and weight. Such thin-film-based ferrite phase shifters disadvantageously become nonlinear, however, at high power levels. A fourth type of phase shifter utilizes a "sliding contact" technique. In one implementation of a sliding-contact phase shifter, coaxial lines "telescope" into or out of one another such that the line length of the phase shifter, and hence the phase imparted thereby, is changed. Such phase shifters, commonly referred to as "line-stretcher" phase shifters, suffer from corrosion and electrical contact problems over time.

Due to the explosive growth of wireless communications, there is a growing need for steerable/tiltable linear phased-array antennas. To meet that need, it would be desirable to have a phase shifter that avoids the drawbacks of the prior art.

SUMMARY OF THE INVENTION

A phase-shifter in accordance with an illustrative embodiment of the present invention comprises a phase-shifting slab having a phase-shifting member, advantageously comprised of a dielectric material. The present phase-shifter is used in conjunction with a quasi-transverse electromagnetic (TEM) transmission line that comprises a signal-carrying ("active") line and a ground plane spaced therefrom. In use, the phase-shifting slab is inserted between the active line and the ground plane. The presence of the phase-shifting member between the active and ground plane provides a "dielectric loading" to the transmission line. The phase-shifting member is advantageously configured so that as it is advanced between the active line and the ground plane, a varying amount of dielectric material passes therebetween. Varying the amount of dielectric material between the active line and the ground plane changes the effective dielectric constant of the transmission line. A change in the effective dielectric constant causes a change in propagation velocity of a signal traveling along the line. In that manner, a signal may be phase shifted relative to another signal in another line.

As used herein, the phrase "phase-shifting range" refers to a range of relative phase-shift that can be imparted by a phase shifter (e.g., 0 to $2\phi$, $-1\phi$ to $2\phi$, etc.). The range is defined by the relative phase shift imparted by the phase-shifting member at a first and a second position. In the first position, the phase-shifting member is not present between the active line and the ground plane (or, more properly, the phase-shifting member does not interact with an electromagnetic field generated between the active line and the ground plane due the presence, in the active line, of a signal). In the second position, the phase-shifting member is positioned between the active line and the ground such that it provides the maximum dielectric loading that it is capable of providing to the transmission line.

The phase-shifting slab advantageously comprises at least one impedance-matching member that decreases a change in impedance ("impedance mismatch") occurring between air-suspended (i.e., no phase-shifting slab between active line and ground) and dielectrically-loaded regions of the transmission line.

As is known in the art, impedance refers, in the present context, to the ratio of the time-averaged value of voltage and current in a given section of the transmission line. This ratio, and thus the impedance of each line section, depends on the geometrical properties of the transmission line, such as, for example, active line width, the spacing between the active line and the ground, and the dielectric properties of the materials employed. If two lines section having different impedance are interconnected, the difference in impedances ("impedance step" or "impedance mismatch") causes a partial reflection of a signal traveling through such line sections. "Impedance matching" is a process for reducing or eliminating such partial signal reflections by disposing a "matching circuit" between the interconnected line segments. As such, impedance matching establishes a condition for maximum power transfer at such junctions.

The impedance-matching member can be designed to eliminate impedance mismatch, but only at one specific frequency. As signal frequency deviates from the one frequency, the impedance mismatch between the dielectrically-loaded and air-suspended regions begins to increase. Even in such cases, as long as the impedance-matching member's design bandwidth is not exceeded, the incidence and severity of signal reflections that occur due to the increasing impedance mismatch are reduced relative to those experienced with conventional phase shifters not possessing an impedance-matching member.

To the extent that conventional phase shifters use impedance-matching "circuits," such circuits are usually incorporated in the active line. Moreover, such circuits are typically useful over a relatively small portion of the phase shifter's useful range of phase shift. To avoid significant impedance mismatch when conventional phase shifters are operated in regions in which the impedance-matching circuit is of marginal effectiveness, such conventional phase shifters are usually comprised of low dielectric constant materials. Such phase shifters need to be relatively large to cause a desirably-wide range of phase shift.

In some embodiments of phase shifters in accordance with the present invention, the impedance-matching member is advantageously configured such that the impedance mismatch is eliminated, or, depending upon signal frequency, substantially reduced, over the full phase-shifting range. Such full-range impedance matching allows the present phase shifters to be comprised of high dielectric constant materials, and therefore smaller than most conventional phase shifters. Alternatively, for a given size, the present phase shifters provide a greater range of phase shift.

In some illustrative embodiments, the phase-shifting member is configured to have a continuous, regular change in width, while maintaining a uniform dielectric constant and thickness throughout. In some such embodiments, a phase-shifting slab is formed from a single piece of dielectric material, wherein the phase-shifting member has the same thickness as the slab, which thickness is typically reduced, as appropriate, to create one or more impedance-matching members. Such monolithic impedance-matched phase-shifting slabs are simple and inexpensive to manufacture. Moreover, due to the continuous, advantageously linear change in the width of the phase-shifting member, there is a linear change in the amount of dielectric material positioned between the active line and the ground as the slab is advanced therebetween. That regular change results in a linear change in phase shift with appropriately- directed slab movement.

DETAILED DESCRIPTION OF THE INVENTION

Phase shifters described in this specification are used in conjunction with a transmission line that includes at least one signal-carrying ("active") line and at least one ground plane. As used herein, the term "transmission line" refers to quasi-transverse electromagnetic (TEM) transmission lines. For wireless telecommunications applications, typically in the range of about 0.5 to 5 gigahertz (GHz), quasi-TEM transmission lines, such as microstrip (one ground) or strip lines (two grounds) are usually employed. For the sake of brevity, most illustrative embodiments of the present description show a phase shifter used in conjunction with a microstrip line. It should be understood, however, that in some embodiments, phase shifters in accordance with the present invention are used in conjunction with strip lines. Regardless of transmission-line configuration, in some embodiments, the active line is advantageously air-suspended (i.e., no dielectric material disposed between the active line and ground). Among any other benefits, such air-suspension reduces signal loss and allows for effective interaction between the phase-shifting member and an electromagnetic field generated by a signal propagating through the active line.

FIGS. 1A & 1B, 1C & 1D, and 1E& 1F depict respective top and cross-sectional views for each of three illustrative configurations of a phase-shifting slab having a phase-shifting member comprised of a material having a suitable dielectric constant for use in a phase shifter. Phase-shifting members for use in conjunction with the present invention are advantageously physically adapted to provide a continuous, regularly-varying phase shift when moved between an active line and a ground plane. More particularly, the various configurations of illustrative phase-shifting members provide a continuous, regularly-varying change in effective dielectric constant of a transmission line. In some embodiments, the regular variation is advantageously linear.

In the present context, the effective dielectric constant $\epsilon_{eff}$ is given by:

$$\epsilon_{eff}=(c_o/c_e)^2 \quad [1]$$

where: $c_o$ is the phase velocity in the air-suspended line (phase-shifting member is not present between the active line and the ground); and $c_e$ is the phase velocity in the dielectrically-loaded line (phase-shifting member is disposed between the active line and the ground).

As noted in the Background section of this Specification, changing the effective dielectric constant of a medium through which an electromagnetic wave travels changes the speed of propagation of that wave. A phase shift therefore results.

Figure 1A:
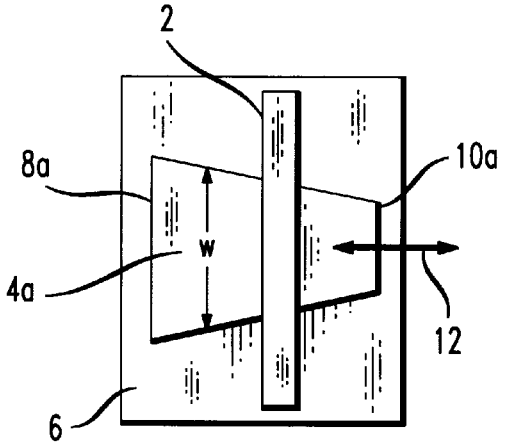
FIGS. 1A & 1B depict, respectively, a top view and a cross-sectional view of a first illustrative configuration for a phase-shifting slab used in a phase shifter in accordance with the present invention.
Figure 1C:
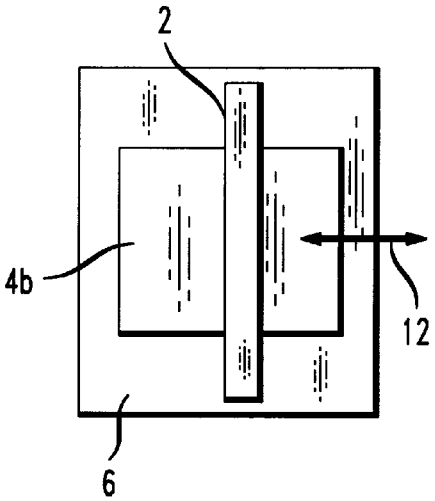
FIGS. 1C & 1D depict, respectively, a top view and a cross-sectional view of a second illustrative configuration for a phase-shifting slab used in a phase shifter in accordance with the present invention.
Figure 1B:
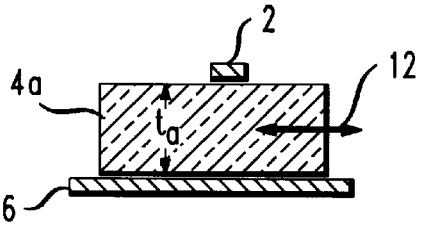

In one embodiment, a continuous, advantageously linearly-varying phase shift is obtained using phase-shifting member 4*a*, shown in FIGS. 1A & 1B. Phase-shifting member 4*a* is configured as a trapezoid (quadrilateral with one set of parallel sides). Phase-shifting member 4*a* advantageously varies linearly in width w between first end 8*a* and second end 10*a*, as depicted in FIG. 1 and has a constant thickness $t_a$ (see FIG. 1B). As phase-shifting member 4*a* is moved in a direction indicated by direction vector 12, the amount of dielectric material between microstrip line 2 and ground plane 6 changes since width w varies (see FIG. 1A). As such, effective dielectric constant $\epsilon_{eff}$ changes and a phase shift is obtained.

In other embodiments, phase-shifting members having other shapes varying in width and suitable for providing a regularly-varying phase response are suitably used. For example, the phase-shifting member can have a triangular configuration, as in many of the illustrative embodiments described later in this specification.

Figure 1D:
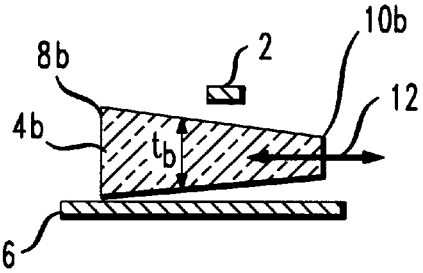

In a second embodiment, a continuous, advantageously linearly-varying phase shift is obtained using phase-shifting member 4*b*, shown in FIGS. 1C & 1D. Rather than changing the width of phase-shifting member 4*b*, its thickness $t_b$ is varied between first end 8*b* and second end 10*b* as depicted in FIG. 1D. As phase-shifting member 4*b* is moved in a direction indicated by direction vector 12 between active line 2 and ground plane 6, the amount of dielectric material passing therebetween changes since thickness $t_b$ varies. As a result, effective dielectric constant $\epsilon_{eff}$ changes and a phase shift is again obtained.

Figure 1E:
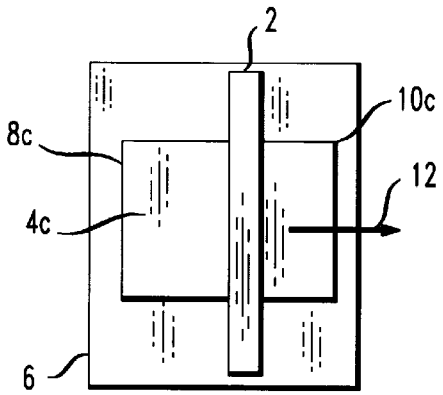
FIGS. 1E & 1F depict, respectively, a top view and a cross-sectional view of a third illustrative configuration for a phase-shifting slab used in a phase shifter in accordance with the present invention.
Figure 1F:
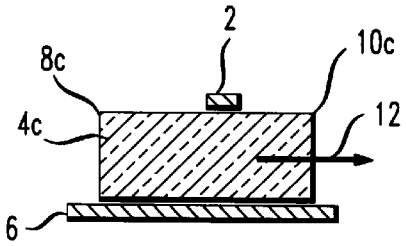

In a third embodiment, a continuous, regularly-varying phase shift is obtained using phase-changing member 4*c*, shown in FIGS. 1E & 1F. Phase-shifting member 4*c* is uniformly shaped, with no changes in width or thickness. To obtain a change in effective dielectric constant, the dielectric constant $\epsilon$ of slab 4*c* itself varies regularly between end 8*c* and end 10*c*. Thus, when slab 4*c* is moved between active line 2 and ground plane 6 along a direction indicated by direction vector 12, effective dielectric constant $\epsilon_{eff}$ changes and a phase shift is once more obtained.

Those skilled in the art will recognize that in the illustrative phase shifters shown in FIGS 1A–1F, there is an impedance mismatch as a signal travels along active line 2 from an air-suspended region (i.e., phase-shifting member absent) to a dielectric-loaded region (i.e., phase-shifting member present). Such impedance mismatch in active line 2 may undesirably result in partial reflections of a signal traveling therethrough. The effective dielectric constant of the transmission line is a function of the dielectric constant of the material, and the amount of such material, disposed between the active line and the ground plane. In accordance with the present invention, the line impedance is changed, and impedance mismatch is reduced or avoided, by providing at least one impedance-matching member that is insertable between the active line and the ground plane. When so inserted, the impedance-matching member provides a dielectric loading suitable for reducing or eliminating potential impedance mismatch, such as between air-suspended and dielectric-loaded regions of the transmission line. The impedance-matching member is advantageously incorporated into a phase-shifting slab of the present phase shifters.

The dielectric constant of the phase-shifting members and impedance-matching members for use in the present phase shifters will suitably be in a range of about 2 to 15. While materials with a lower or higher dielectric constant can be used, an increase in size of the phase-shifting members (with decreasing dielectric constant), and an increase in sensitivity to mechanical tolerances and slab positioning (with increasing dielectric constant), generally makes the use of such materials less desirable. Materials suitable for use as the phase-shifting and impedance-matching members are well known to those skilled in the art.

Figure 2A:
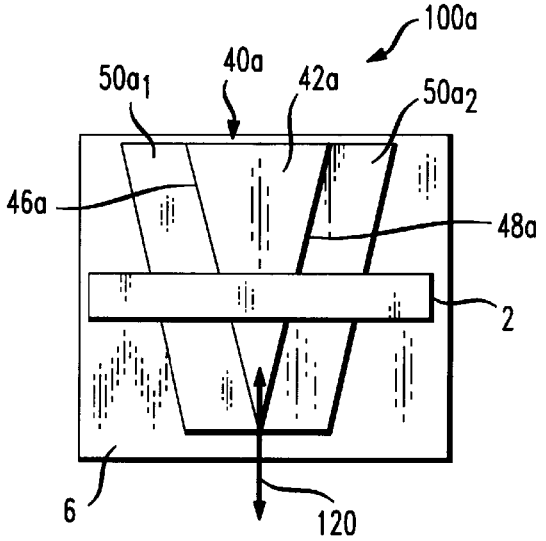
FIGS. 2A & 2B depict, respectively, a top view and a cross-sectional view of a phase shifter having two impedance-matching members and used in conjunction with a straight transmission line in accordance with a first illustrative embodiment of the invention.
Figure 2B:
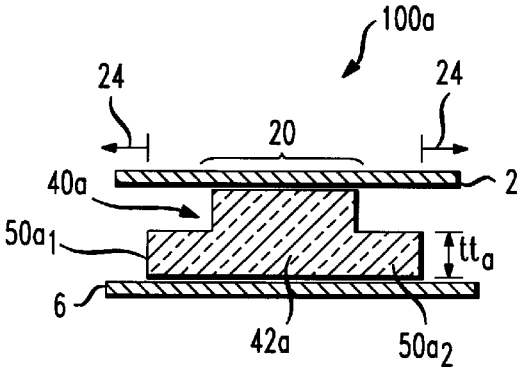

FIGS. 2A & 2B depict respective top and cross-sectional views of phase shifter 100*a* in accordance with a first illustrative embodiment of the present invention. Phase shifter 100*a* comprises phase-shifting slab 40*a* (hereinafter "slab"), comprising phase-shifting member 42*a* advantageously having a triangular shape. As slab 40 is moved in a direction between active line 2 and ground 6 in the direction indicated by direction vector 120 (see FIG. 2A), a continuous phase shift results in a signal propagating within active line 2 relative to another signal traveling in another active line (not shown).

Slab 40*a* further comprises two impedance-matching members $\mathbf{50}a_1$, $\mathbf{50}a_2$ suitable for reducing or eliminating impedance mismatch. In the illustrative embodiment shown in FIGS. 2A & 2B, the phase-shifting member 42*a* and the impedance-matching members $\mathbf{50}a_1$, $\mathbf{50}a_2$ are advantageously formed from a single dielectric slab having a first thickness. The thickness of phase-shifting member 42*a* is equal to the first thickness. Slab thickness is simply stepped (i.e., reduced) as appropriate, on both sides of phase-shifting member, to create two impedance-matching members $\mathbf{50}a_1$, $\mathbf{50}a_2$ having thickness $tt_a$ (see FIG. 2B) that provide a dielectric loading suitable for reducing or avoiding impedance mismatch. The width of each impedance-matching member advantageously provides 90 degrees of phase.

As is known to those skilled in the art, no simple expression describes the relation between the thickness and width of a layer of dielectric material and that layer's effect on line impedance. The required calculations can be performed using a "method-of-moment" calculation known to those skilled in the art. Such calculations are rather tedious and are usually performed with the aid of a software "tool." In particular, an electromagnetic (EM) simulator, such as Momentum™, available from Hewlett-Packard Company of Palo Alto, Calif.; IE3D™, available from Zeland Software of Frement, Calif.; and Sonnet™, available from Sonnet Software of Liverpool, N.Y., may be used for this purpose.

Line impedance $Z_t$ of each impedance-matching member is given by the expression:

$$Z_t=(Z_aZ_d)^{1/2} \quad [2]$$

where: $Z_a$ is the line impedance of the air-suspended portion of the active line; and $Z_d$ is the line impedance of the dielectrically-loaded of the active line.

Referring to FIG. 2B, $Z_d$ is the line impedance for region 20 of active line 2 and $Z_a$ is the line impedance for region 24 of active line 2.

In the illustrative embodiment shown in FIGS. 2A & 2B, only one impedance-matching member is disposed one each side of phase-shifting member 42*a* of slab 40*a*. In other embodiments (not shown), multiple impedance-matching members having a reduced width relative to the impedance-matching members $\mathbf{50}a_1$, $\mathbf{50}a_2$ are located in the same regions. In those other embodiments, each successive impedance-matching member is thicker than the previous one. The use of such multiple impedance-matching members advantageously provides a more gradual impedance transition for broadband applications when signal frequency deviates from the impedance-matching design center frequency. The impedance of the impedance-matching member "k" is given by:

$$Z_k=(Z_{k+1}Z_{k-1})^{1/2} \quad [3]$$

Figure 2E:
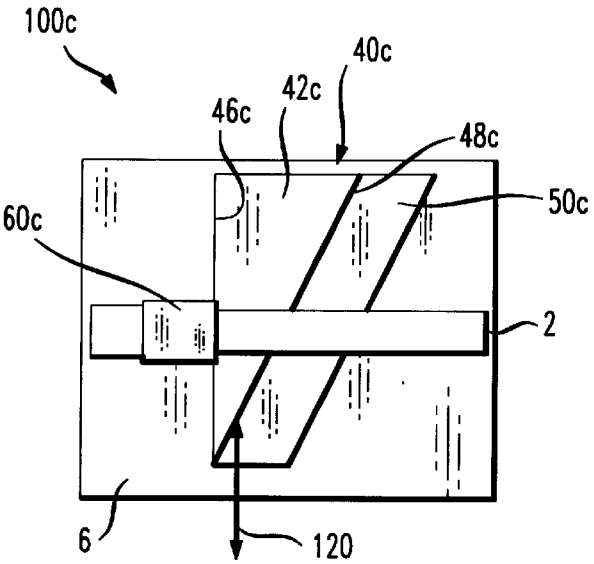
FIGS. 2E & 2F depict, respectively, a top view and a cross-sectional view of a phase shifter having one impedance-matching member and used in conjunction with a straight transmission line in accordance with a third illustrative embodiment of the invention.
Figure 2F:
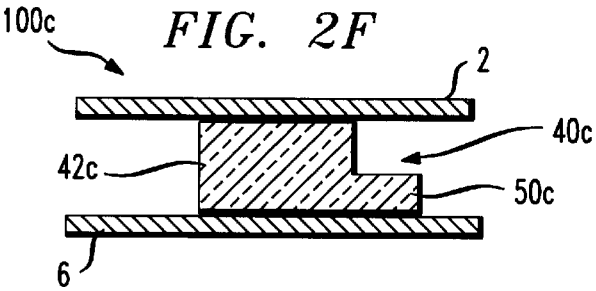
Figure 2C:
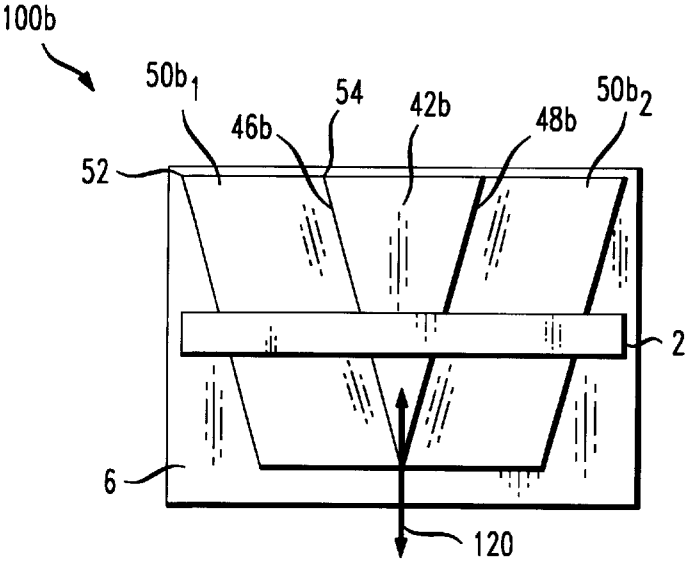
FIGS. 2C & 2D depict, respectively, a top view and a cross-sectional view of a phase shifter having two impedance-matching members and used in conjunction with a straight transmission line in accordance with a second illustrative embodiment of the invention.
Figure 2D:
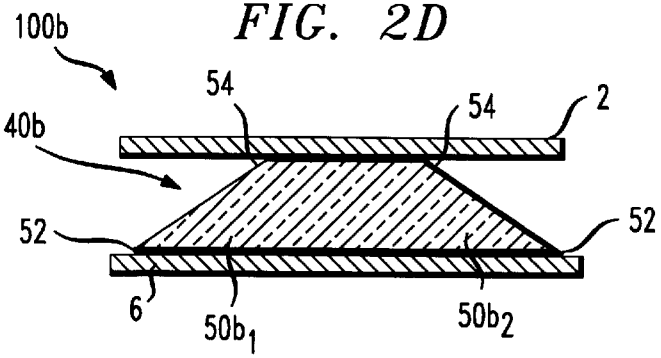

FIGS. 2C & 2D depict respective top and cross-sectional views of phase shifter 100*b* in accordance with a second illustrative embodiment of the present invention. Phase shifter 100*b* includes slab 40*b*. Slab 40*b* is moved between active line 2 and group plane 6 in a direction indicated by direction vector 120 (see FIG. 2C) between active line 2 and ground 6 to cause a continuous phase shift in a signal propagating within active line 2 relative to another signal traveling in another active line.

Slab 40*b* includes two impedance-matching members $\mathbf{50}b_1$, $\mathbf{50}b_2$ having a thickness that advantageously varies regularly between first edge 52 and second edge 54. Line impedance (in the transitional region) is thus a function of the relative position between first edge 52 and second edge 54 of the impedance-matching member and independent of the width of phase-shifting member 42*b* (see FIG. 2C). Tapered impedance-matching members $\mathbf{50}b_1$, $\mathbf{50}b_2$ represent a logical conclusion of the use of an increasing number of discrete impedance-matching members.

Referring to FIGS. 2A, 2B, 2C & 2D, phase shifters 100*a* and 100*b* having two identical impedance-matching members, one disposed on each side of respective phase-shifting members 42*a* and 42*b*, are particularly well suited to applications in which input impedance is substantially the same as the output impedance. The term "input impedance" refers to the impedance of the active line 2 at the leading edge of the phase-shifting member (e.g., loading edge 46*a* in FIG. 2A) and the term "output impedance" refers to the impedance of the active line 2 at the trailing edge of the phase-shifting member (e.g., trailing edge 48*a* in FIG.2A). In other applications, however, input impedance is different from output impedance. As such, the two impedance-matching members may require different physical configurations. In such applications, one of the impedance-matching members is advantageously implemented in active line 2 rather than in the slab, as is illustrated in FIGS. 2E–2H.

FIGS. 2E & 2F depict respective top and cross-sectional views of phase shifter 100*c* in accordance with a third illustrative embodiment of the present invention. Phase shifter 100*c* includes slab 40*c*. Slab 40*c* is moved in a direction indicated by direction vector 120 (see FIG. 2E) between active line 2 and ground 6 to cause a continuous phase shift in a signal propagating within active line 2 relative to another signal traveling in another active line (not shown).

Slab 40*c* has one impedance-matching member 50*c*, similar to impedance-matching member 50*a* previously described. An impedance "circuit" 60*c* is located in active line 2 as depicted in FIG. 2E. Leading edge 46*c* of phase-shifting member 42*c* of slab 40*c* is advantageously orthogonal to active line 2 to facilitate impedance matching via circuit 60*c*. Line-integrated impedance circuits, such as the circuit 60*c*, are implemented in a known fashion, such as, for example, by changing active line width, thickness, or by changing the gap between the active line and the ground plane.

It will be appreciated that in other embodiments (not depicted), the configuration of phase shifter 100*c* (FIG. 2E) can be changed wherein the relative positions of the impedance circuit 60*c* and the impedance-matching member 50*c* are reversed (i.e., the slab-integrated member 50*c* is located at leading edge 46*c* of the main portion 42*c*, and line-integrated circuit 60*c* is located at trailing edge 48*c*). In such other embodiments, leading edge 46*c* is tapered and trailing edge 46*c* is orthogonal to active line 2 (to facilitate impedance matching with circuit 60*c*).

Figure 2G:
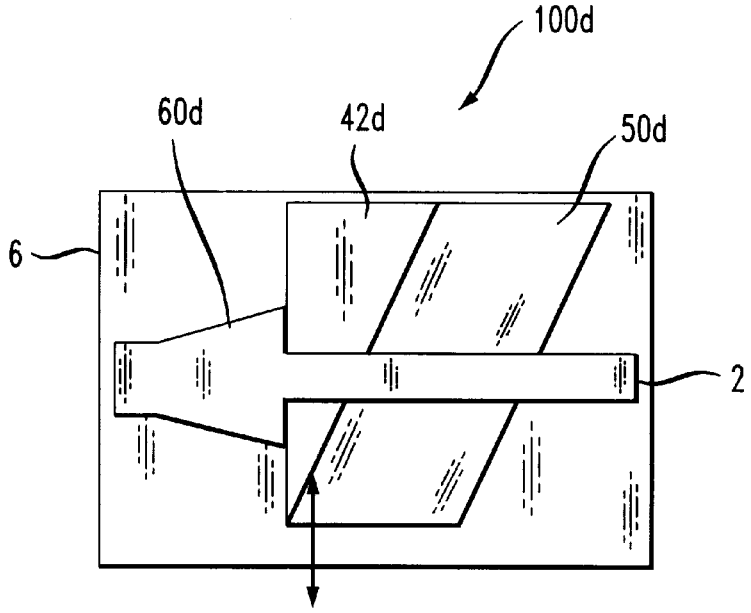
FIGS. 2G & 2H depict, respectively, a top view and a cross-sectional view of a phase shifter having one impedance-matching member and used in conjunction with a straight transmission line in accordance with a fourth illustrative embodiment of the invention.
Figure 2H:
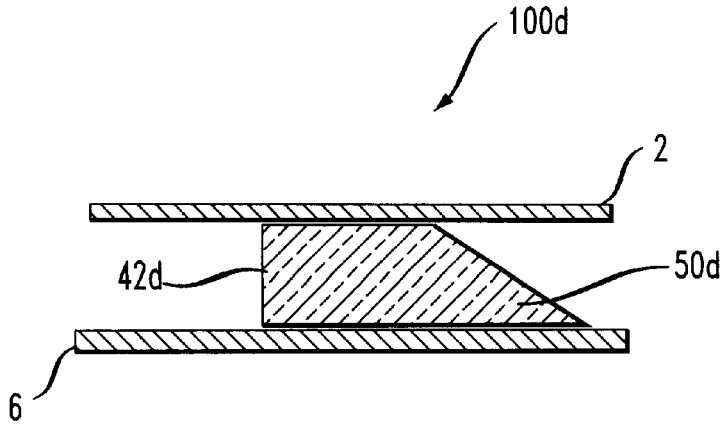

FIGS. 2G & 2H depict respective top and cross-sectional views of phase shifter 100*d* in accordance with a fourth illustrative embodiment of the present invention. Phase shifter 100*d* utilizes a single impedance-matching member 50*d* and one line-integrated impedance circuit 60*c*, like phase shifter 100*c*. Phase-shifting member 42*d* is moved between active line 2 and ground 6 in a direction indicated by direction vector 120 causing a continuous phase shift in a signal propagating in active line 2 relative to other signals propagating in other active lines (not shown). Impedance-matching member 50*d* has a tapered profile like members 50$b_1$, 50$b_2$ (see FIG. 2D). Line-integrated impedance circuit 60*d* provides a more gradual impedance transition (relative to an impedance circuit that is not tapered) when signal frequency deviates from the impedance-matched frequency. In some embodiments, line-integrated impedance circuit 60*d* is implemented as a gradual increase in the width of active line 2.

It will be appreciated that the preferred phase-shifter configuration may vary as a function of the specifics of any given application (e.g., type of antenna feed-network, etc.). One configuration that is expected to be advantageous for integration with some antenna arrays comprises a trapezoidal phase-shifting slab and straight active line, such as has been described and depicted above. Several other configurations are described below and depicted in FIGS. 3–7. It should be understood that the impedance-matching members used in the illustrative phase shifters described below can be implemented in accordance with any of the previously-described configurations (e.g., a single member having uniform thickness, a series of members having different thicknesses, tapered members, etc.). Moreover, while the impedance-matching members are advantageously configured for eliminating or reducing the impedance step over the full phase-shifting range, in other embodiments, such impedance-matching members are configured for impedance matching over only a portion of the phase-shifting range of the phase shifters.

Figure 3:
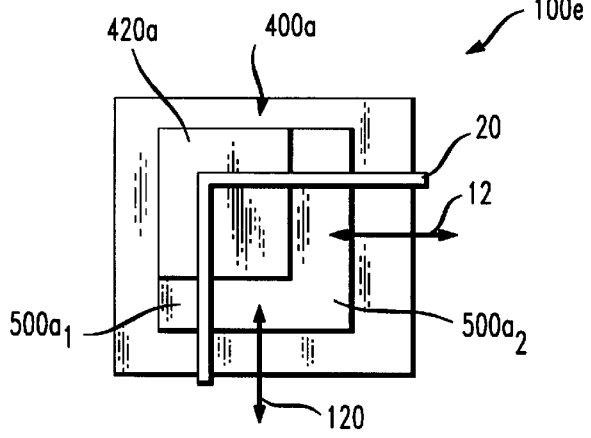
FIG. 3 depicts a top view of a phase shifter having two impedance-matching members and used in conjunction with an L-shaped active line in accordance with a fifth illustrative embodiment of the invention.

FIG. 3 depicts a top view of phase shifter 100*e* having rectangularly-shaped slab 400*a* comprising phase-shifting member 420*a* and two impedance-matching members 500$a_1$, 500$a_2$ in accordance with a fifth illustrative embodiment of the invention. Phase shifter 100*e* is depicted with illustrative L-shaped active line 20. In the illustrative embodiment depicted in FIG. 3, the slab can be moved in the directions indicated by direction vectors 12 and 120.

Figure 4:
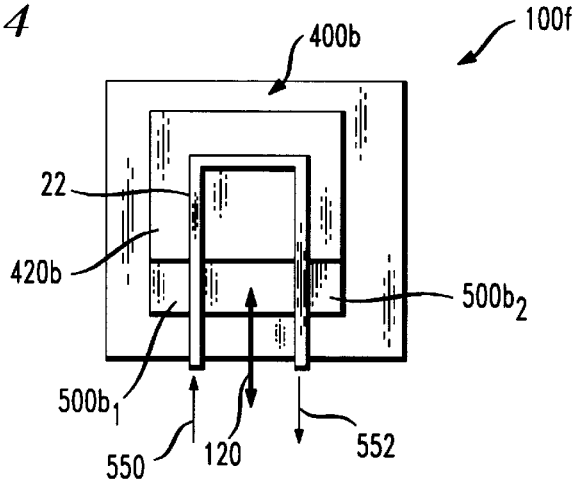
FIG. 4 depicts a top view of a phase shifter having multiple impedance-matching members (functionally) and used in conjunction with a U-shaped active line in accordance with a sixth illustrative embodiment of the invention.

FIG. 4 depicts a top view of phase shifter 100*f* having rectangularly-shaped slab 400*b* comprising phase-shifting member 420*b* and, functionally, "two" impedance-matching members 500$b_1$, 500$b_2$ in accordance with a seventh illustrative embodiment of the invention. Phase shifter 100*f* is depicted with illustrative U-shaped active line 22. Phase shifter 100*f* is described to have "two" impedance-matching members even though such members are physically a single entity. The reason for that is that two impedance "transformations" are provided. In particular, a first transformation is provided for input signal 550 and a second transformation is provided for output signal 552. As such, phase shifter 100*f* provides the functional equivalent of two impedance-matching members. The U-shaped configuration of active line 22 allows for additional phase shift relative to straight active line 2, since more line is dielectrically-loaded. The slab is movable in a direction indicated by direction vector 120.

Figure 5:
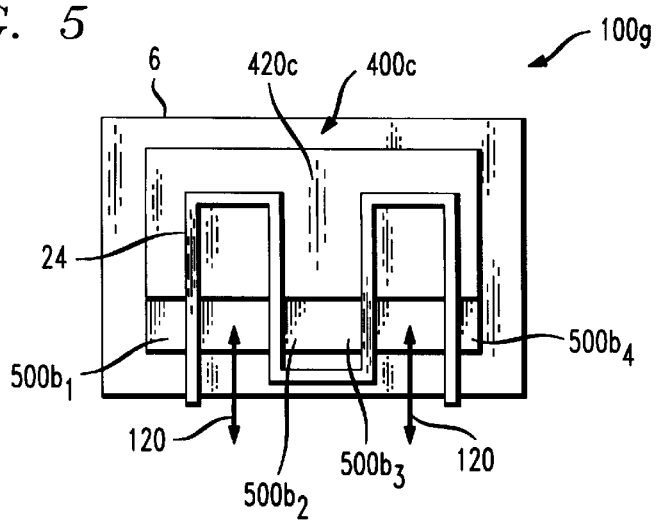
FIG. 5 depicts a top view of a phase shifter having multiple impedance-matching members (functionally) and used in conjunction with a plural U-shaped active line in accordance with a seventh illustrative embodiment of the invention.

FIG. 5 depicts a top view of phase shifter 100*g* having rectangularly-shaped slab 400*c* comprising phase-shifting member 420*c* and, functionally, four impedance-matching members 500$b_1$, 500$b_2$, 500$b_3$, 500$b_4$ in accordance with an eighth illustrative embodiment of the invention. Phase shifter 100*g* is depicted with illustrative plural U-shaped active line 24. Phase-shifting member 420*c* is moved between active line 24 and ground 6 in a direction indicated by direction vector 120 to cause a continuous phase shift in a signal propagating in active line 24 relative to another signal propagating in another active line (not shown). The plural-U configuration provides additional phase shift relative to the single-U configuration of phase shifter 100*f*.

Figure 6:
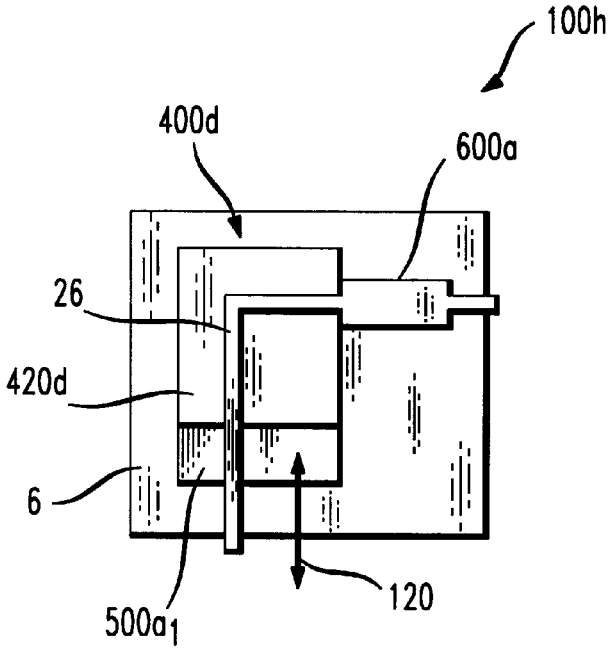
FIG. 6 depicts a top view of a phase shifter having one impedance-matching member and used in conjunction with a L-shaped active line having an impedance circuit in accordance with an eighth illustrative embodiment of the invention.

FIG. 6 depicts a top view of phase shifter 100*h* having rectangularly-shaped slab 400*d* comprising phase-shifting member 420*d* and one impedance-matching member 500$a_1$ in accordance with a ninth illustrative embodiment of the invention. Phase-shifter 100*h* is depicted with illustrative L-shaped active line 26 having one line-integrated impedance circuit 600*a*. In the illustrative embodiment depicted in FIG. 6, the slab is movable between active line 26 and ground 6 in a direction indicated by direction vector 120.

Figure 7:
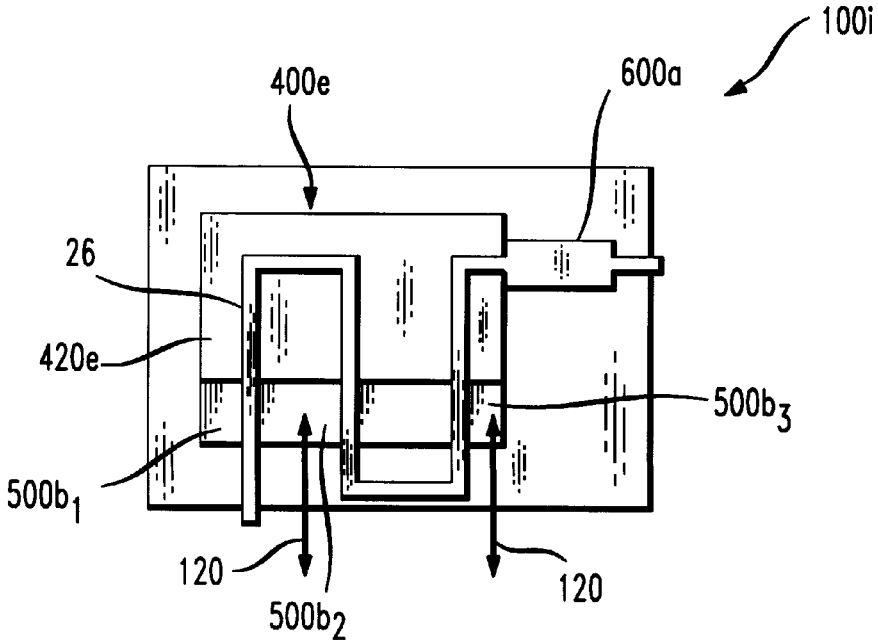
FIG. 7 depicts a top view of a phase shifter having multiple impedance-matching members (functionally) and used in conjunction with a compound U/L-shaped active line having an impedance circuit in accordance with a ninth illustrative embodiment of the invention.

FIG. 7 depicts a top view of phase shifter 100*i* having rectangularly-shaped slab 400*e* comprising phase-shifting member 420*e* and three impedance-matching members 500$b_1$, 500$b_2$, 500$b_3$ integrated in a dielectric slab in accordance with a tenth illustrative embodiment of the invention. Phase shifter 100*i* is depicted with illustrative U/L-shaped active line 26 having one line-integrated impedance circuit 600*a*. Slab 400*e* is movable in a direction indicated by direction vector 120.

In the above-described and illustrated embodiments, the phase-shifting members had a rectangular or triangular shape. It should be understood, that in other embodiments, other shapes may suitably be used. Advantageously, such other configurations will result in a regular increase in phase shift as a function of slab position.

In the phase shifters described above, the phase-shifting member is inserted into the "main" field located between the active line and the ground plane. In other embodiments, the phase-shifting member is inserted into the "fringing" field located on top of the active line. In such embodiments, the effective phase shift per unit line length is disadvantageously substantially smaller than that obtained when the phase-shifting member is inserted into the main field. Moreover, in such embodiments, the effective phase shift is disadvantageously very sensitive to relatively small variations in the gap between the phase-shifting member and the active line.

Figure 8:
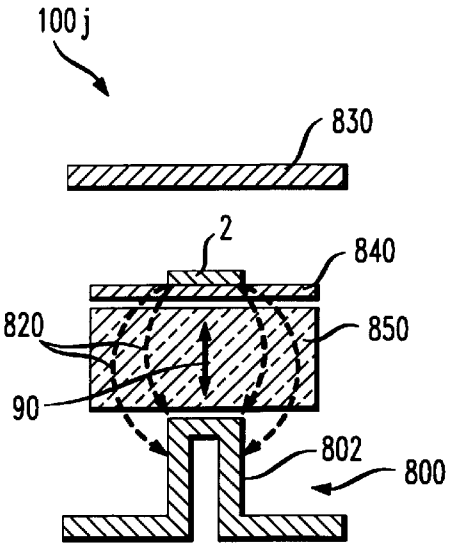
FIG. 8 depicts a cross-sectional view of phase shifter and a transmission line utilizing a ground plane having an "exposed-ground" configuration in accordance with a tenth illustrative embodiment of the invention.

FIG. 8 depicts a cross-sectional view of phase shifter 100*j* used with a transmission line advantageously having an "exposed-ground" configuration in accordance with an illustrative embodiment of the present invention. In the "exposed-ground" configuration, a portion 802 of ground plane 800 is closer to air-suspended active line 2 disposed on circuit board 840 than the rest of the ground plane 800. The portion 802 has a width substantially equal to that of active line 2. Such a configuration results in a more symmetric field distribution 820 than the "standard" ground plane configuration shown in the other Figures. FIG. 8 shows phase-shifting member 850 inserted between active line 2 and portion 802 of ground plane 800 for phase shifting. Cover 830 is located above active line 2.

Figure 9:
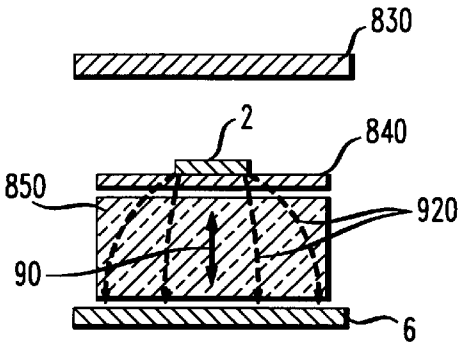
FIG. 9 depicts a field distribution for a "standard" microstrip line ground plane configuration.

Electromagnetic field distribution 920 for a "standard" ground plane configuration is depicted in FIG. 9. In such a standard configuration, there is uniform spacing between ground 6 and air-suspended active line 2 that is disposed on circuit board 840. FIG. 9 shows phase-shifting member 850 inserted between active line 2 and ground 6 for phase shifting. Cover 830 is disposed above active line 2. Field distribution 920 is less symmetric than field distribution 820. The more symmetric field distribution obtained with the exposed-ground configuration advantageously leads to reduced variations (less sensitivity) in the effective dielectric constant to mechanical motion of the phase-shifting member in the "vertical" direction indicated by direction vector 90 (see FIGS. 8, 9). The exposed-ground configuration illustrated in FIG. 8 does, however, disadvantageously result in a slight reduction in the effective dielectric constant relative to the standard ground configuration.

Figure 10:
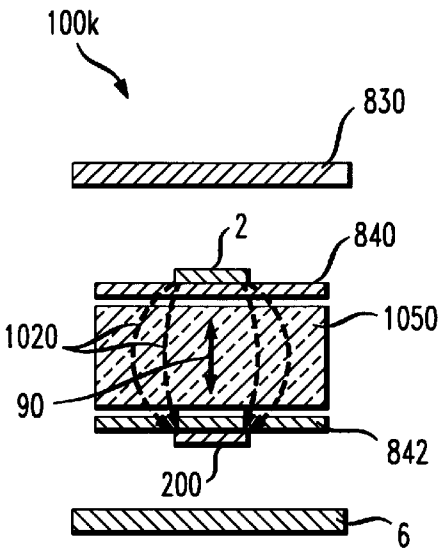
FIG. 10 depicts a cross-sectional view of phase shifter and dual-polarity strip line having two active lines in accordance with an eleventh illustrative embodiment.

FIG. 10 depicts a cross-sectional view of phase shifter 100*k* utilized with a "dual-polarity" transmission line having two air-suspended active lines 2 and 200 in accordance with an illustrative embodiment of the present invention. In FIG. 10, active lines 2 and 200 are shown disposed on circuit boards 840 and 842. Cover 830 is disposed "above" active line 2 and ground 6 is disposed "beneath" active line 200 in FIG. 10. Phase-shifting member 1050 is inserted between the two active lines. Such a configuration provides a very highly-symmetric field distribution 1020, resulting in less variation in the effective dielectric constant with mechanical motion of the phase-shifting member along the direction vector 90 than for the configuration illustrated in FIG. 8.

As described in more detail in U.S. Pat. No. 5,905,462 and U.S. Pat. No. 5,940,030, phase shifters in accordance with the illustrative embodiments of the present invention are readily integrated into phased-array antennas to steer/tilt the antenna radiation pattern.

It is to be understood that the embodiments described herein are merely illustrative of the many possible specific arrangements that can be devised in application of the principles of the invention. Other arrangements can be devised in accordance with these principles by those of ordinary skill in the art without departing from the scope and spirit of the invention. It is therefore intended that such other arrangements be included within the scope of the following claims and their equivalents.

We claim:

1. An article for imparting a phase shift to a signal traveling through a transmission line, the transmission line having at least one active line and at least one ground, wherein the one line and the one ground are disposed in spaced and parallel relation to one another, the article comprising:

a phase-shifting slab movable in the space between the active line and ground, the phase-shifting slab having:

a phase-shifting member having a regular variation in dielectric constant, said phase-shifting member operable to provide a regular change in an effective dielectric constant of the transmission line as the phase-shifting member is moved through said space; and a first impedance-matching member operable to reduce impedance mismatch that occurs as the signal travels from a first region of the transmission line having a first impedance to a second region of the transmission line having a second impedance, wherein said first impedance-matching member is physically configured to reduce impedance mismatch across a full range of movement of said phase-shifting slab in said space;

wherein, in the first region, the phase-shifting slab is not present between the active line and the ground, and, in the second region, at least a portion of the phase-shifting slab is disposed between the active line and the ground.

2. The article of claim 1, wherein the signal is characterized by a frequency such that the impedance-matching member substantially eliminates the impedance mismatch.

3. The article of claim 1, wherein said phase-shifting slab is movable in a non-axial direction with respect to said active line.

4. The article of claim 1, and further comprising a second impedance-matching member, wherein the second impedance-matching member reduces a second impedance mismatch that occurs as the signal travels from the second region of the transmission line to a third region of the transmission line having a third impedance, wherein, in the third region, the phase-shifting slab is not present between the active line and the ground.

5. The article of claim 4, wherein the first impedance is substantially equal to the third impedance.

6. The article of claim 5, wherein the second impedance-matching member depends from the phase-shifting member.

7. The article of claim 4, wherein the first impedance is substantially different than the third impedance.

8. The article of claim 1, wherein said non-axial direction is a transverse direction.

9. The article of claim 1, wherein an impedance circuit is disposed in a third region of the transmission line, said impedance circuit operable to reduce impedance mismatch that otherwise occurs as said signal travels from said second region of said transmission line to said third region of said transmission line, wherein, in the third region, said phase-shifting slab is not present between said active line and said ground.

10. An article for phase shifting, comprising:

a transmission line for carrying a signal, the transmission line having an active line spaced from a ground wherein;

said active line has a first width;

said ground has a first portion proximal to said active line and a second portion distal to said active line, and said first portion has a width that is substantially the same as said first width of said active line;

a phase-shifting slab movable in the space between the active line and the ground, the phase-shifting slab comprising;

a phase-shifting member comprised of a dielectric material and having a regular variation in width;

a first impedance-matching member comprised of a dielectric material and operable to reduce impedance mismatch that occurs in the transmission line due to the presence of the dielectric material between the active line and the ground, wherein said first impedance-matching member is physically configured to reduce impedance mismatch across a full range of movement of said phase-shifting slab in said space; wherein, as the phase-shifting slab is moved in a direction in the space, an amount of dielectric material disposed between the active line and the ground varies due to the variation in width of the phase-shifting member.

11. The article of claim 10, wherein said phase-shifting slab is movable in a non-axial direction with respect to said active line.

12. The article of claim 11, wherein said non-axial direction is a transverse direction.

* * * * *